US007930860B2

(12) United States Patent
Sawada

(10) Patent No.: US 7,930,860 B2
(45) Date of Patent: Apr. 26, 2011

(54) WINDOW DRAIN

(75) Inventor: Koji Sawada, Anjo (JP)

(73) Assignee: Nichiha Corporation, Nagoya-Shi (JP)

( * ) Notice: Subject to any disclaimer, the term of this patent is extended or adjusted under 35 U.S.C. 154(b) by 92 days.

(21) Appl. No.: 12/216,310

(22) Filed: Jul. 2, 2008

(65) Prior Publication Data

US 2009/0007505 A1 Jan. 8, 2009

(30) Foreign Application Priority Data

Jul. 2, 2007 (JP) ..... 2007-005038 U

(51) Int. Cl.
*E06B 7/14* (2006.01)
*E06B 7/26* (2006.01)

(52) U.S. Cl. ..... 52/209; 52/97; 49/408

(58) Field of Classification Search ..... 52/209, 52/58, 302.6, 302.1, 97; 49/408, 476.1
See application file for complete search history.

(56) References Cited

U.S. PATENT DOCUMENTS

| | | | | | |
|---|---|---|---|---|---|
| 868,413 | A | * | 10/1907 | Cramer | 52/97 |
| 1,904,404 | A | * | 4/1933 | Burk | 52/62 |
| 2,570,336 | A | * | 10/1951 | Fouts | 52/209 |
| 2,648,107 | A | * | 8/1953 | Bates, Jr. | 52/97 |
| 2,697,932 | A | * | 12/1954 | Goodwin | 52/97 |
| 2,856,995 | A | * | 10/1958 | Roth | 160/44 |
| 2,918,706 | A | * | 12/1959 | Rust et al. | 49/408 |
| 3,314,201 | A | * | 4/1967 | Riegelman | 52/209 |
| 3,638,372 | A | * | 2/1972 | Rosenthal | 52/97 |
| 4,154,033 | A | * | 5/1979 | Krueger et al. | 52/209 |
| 4,492,062 | A | * | 1/1985 | Levenez | 52/97 |
| 4,555,882 | A | * | 12/1985 | Moffitt et al. | 52/209 |
| 4,682,451 | A | * | 7/1987 | Hubble | 52/97 |
| 5,123,212 | A | * | 6/1992 | Dallaire et al. | 52/209 |
| 5,887,387 | A | * | 3/1999 | Dallaire | 49/408 |
| 5,921,038 | A | * | 7/1999 | Burroughs et al. | 52/209 |
| 6,038,821 | A | * | 3/2000 | Larson et al. | 52/97 |
| 6,098,343 | A | * | 8/2000 | Brown et al. | 52/11 |
| 6,170,207 | B1 | * | 1/2001 | Saindon | 52/204.2 |
| 6,360,500 | B1 | * | 3/2002 | Wilcox | 52/217 |

(Continued)

FOREIGN PATENT DOCUMENTS

JP 8-100578 A 4/1996

(Continued)

*Primary Examiner* — Khoi Tran
*Assistant Examiner* — Jason Holloway
(74) *Attorney, Agent, or Firm* — Birch, Stewart, Kolasch & Birch, LLP

(57) ABSTRACT

A window drain for preventing stains on a building wall and damage caused by frozen rain water, which is installable and sealable easily without impairing the appearance of a building. The present invention relates to a window drain adapted to be positioned at the portion beneath each vertical post of a sash window frame comprising a vertical portion, a sloping portion, a front portion and a horizontal portion for latching itself to an upper portion of an external wall. Further, the present invention relates to the window drain, wherein the horizontal portion has a notch at an end thereof and a sealing pocket. Further, the present invention relates to a window drain, further comprising upstanding portions to regulate a stream of water so that the water is kept between the upstanding portions, at both ends of the window drain wherein one upstanding portion is located at the inner side of the vertical portion of a sash window frame, and the other upstanding portion is located at the outer side of the vertical portion of a sash window frame.

4 Claims, 4 Drawing Sheets

U.S. PATENT DOCUMENTS

| | | | | |
|---|---|---|---|---|
| 6,385,925 | B1 | 5/2002 | Wark | |
| 6,484,446 | B2 * | 11/2002 | Young | 49/469 |
| 6,976,338 | B2 * | 12/2005 | Olk et al. | 52/97 |
| 7,134,245 | B2 * | 11/2006 | Burton | 52/209 |
| D537,542 | S * | 2/2007 | Habeck et al. | D25/124 |
| 7,644,547 | B2 * | 1/2010 | Bonshor | 52/209 |
| 7,775,004 | B2 * | 8/2010 | Allen | 52/209 |
| 2003/0106269 | A1 * | 6/2003 | Bauman et al. | 49/467 |
| 2005/0034388 | A1 * | 2/2005 | Bealko | 52/204.5 |
| 2005/0055912 | A1 * | 3/2005 | Teodorovich | 52/261 |
| 2005/0144865 | A1 * | 7/2005 | Ellingson | 52/272 |
| 2005/0210768 | A1 * | 9/2005 | Lawson et al. | 52/97 |
| 2008/0245001 | A1 * | 10/2008 | Alkoury et al. | 52/204.5 |
| 2009/0007505 | A1 * | 1/2009 | Sawada | 52/209 |
| 2009/0272045 | A1 * | 11/2009 | Teodorovich | 52/58 |
| 2010/0018129 | A1 * | 1/2010 | Hotton et al. | 52/58 |

FOREIGN PATENT DOCUMENTS

| | | | |
|---|---|---|---|
| JP | 2004-353198 | A | 12/2004 |

* cited by examiner

WINDOW DRAIN

This non-provisional application claims priority under 35 U.S.C. §119(a) on Japanese Patent Application No. JP2007-005038U, filed on Jul. 2, 2007, which is herein incorporated by reference.

FIELD OF THE INVENTION

The present invention relates to a window drain adapted to be positioned beneath a sash window frame of a building.

BACKGROUND OF THE INVENTION

A variety of structures of window drains are known in the art. For example, in the case where a window drain is installed underneath a sash window frame, window drains having a vertical portion which is fixable to a wall and further wherein the vertical portion has holes (openings) for accepting a screw to fix the window drain are known. The hole extends downwardly and an end of the hole is open so that an adjustment in a vertical direction can be carried out easily. Further, a window drain may have a round concave portion so that sealing material can be filled into the space between an external wall and the window drain. (JP 08-100578 A.)

Further, a window drain for preventing rain water drops can be installed beneath a sash window frame so that the window drain extends from an external wall so as to prevent stains caused by rain water and damage caused by frozen water. Such a window drain has a guide portion and a contact portion contacting an external wall. The guide portion has an upper portion inclining downwardly, a front portion extending vertically, a curved portion which smoothly connects the upper portion and the front portion, and a curved end at the end of the front portion. (JP 2004-353198 A).

However, it is usually necessary to provide a space of approximately 10 mm, for example, so that a sealing material can be installed and fixed between a lower portion of the window frame and an upper portion of the external wall. In accordance with the method of JP 08-100578 A, there are drawbacks. For example, another sealing means must be employed and fixed at the proximity of an upper portion of a window drain so as to seal the space between a window drain and the external wall. Consequently, two (2) sealing portions appear and the appearance at the proximity of the window drain is impaired. Further, when such a window drain is installed, it is usually necessary for a worker(s) to install and fix the window drain in a suitable position with screws, while holding the window drain by hand. Such a process is troublesome and with this technique it is not easy to install and fix a window drain in the correct position.

BRIEF SUMMARY OF THE INVENTION

A primary object of the present invention is to substantially eliminate such problems of conventional technologies. For example, according to the present invention, a window drain can be installed and sealed more easily and thus workability can be improved. Furthermore, another object is to provide a window drain, which can prevent stains caused by rain drops and damage caused by frozen water (e.g., frozen rain) effectively, without impairing the appearance of a building in which the window drain is installed.

To achieve the above mentioned objects, the present invention provides a window drain adapted to be positioned at the portion beneath each vertical post of a sash window frame comprising a vertical portion, a sloping portion, a front portion and a horizontal portion for latching itself to an upper portion of an external wall. Further, the present invention is directed to a window drain wherein the horizontal portion has a notch at an end thereof and a sealing pocket. Further, the present invention comprises a window drain further comprising upstanding portions to regulate a stream of water so that the water is kept between the upstanding portions, at both ends of the window drain wherein the one upstanding portion is located at the inner side of a vertical post of a sash window frame, and the other upstanding portion is located at the outer side of a vertical post of a sash window frame. Further, the present invention is related to a window drain adaptable to be positioned at the portion beneath each vertical post of a sash window frame comprising a horizontal portion for latching itself to an upper portion of an external wall, a sloping portion extending downwardly from the horizontal portion, a vertical portion extending downwardly from the upper end of the sloping portion, and a front portion extending downwardly from the lower end of the sloping portion.

Usually, approximately 10 mm of space, within which a sealing material is inserted and fixed, is provided between the sill of a sash window frame and the upper portion of an external wall. According to the present invention, since the window drain has a horizontal portion for latching itself to an upper portion of an external wall, the window drain can be disposed so that the horizontal portion is located between a sill of a sash window frame and an upper portion of an external wall. Consequently, it is unnecessary to hold the window drain by hand so as to keep the window drain on the external wall when installing the window drain. That is an advantageous property of the present invention.

Further, since the sealing is located underneath the lower portion of the sash window frame, the sealing can be kept in as low profile as possible. Thus, it is not very visible. Further, since a window drain is disposed at the position close to the sealing material, the appearance of the window drain and the proximity thereof is apparently simplified and thus an excellent appearance is obtained. Further, since a horizontal portion for latching to an upper portion of an external wall has a notch at an end of a window drain, the surface of the external wall adjacent to the sealing material can also be sealed and thus adhesiveness between an external wall and the sealing can be improved effectively. Further, there is a sealing pocket, thereby preventing rain water, which comes down on a sash window frame and drops down to a window drain, from going around behind the window drain. Thus, it is assured that rain water goes downwardly along a sloping portion and the front portion of a window drain.

Further, it is preferable that a window drain has upstanding portions in order to regulate a stream of rain water at the right and left ends of the window drain. Rain water is received by a window drain and regulated by the upstanding portions so that it goes downwardly between the upstanding portions. Consequently, rain water is effectively prevented from touching the external wall.

Further, it is preferred that an upstanding portion disposed at the inner side is shorter than an upstanding portion disposed at the outer side. Since the one upstanding portion disposed at the inner side is shorter, the height of an upper portion of the other upstanding portion disposed at the inner side becomes approximately the same as the height of a sealing material when the window drain and the sealing are installed beneath a sash window frame. Therefore, the sealing workability and the sealing property can be improved effectively. Consequently, stains on an external wall under a sash window frame caused by rain water and damage caused by frozen rain water can be effectively avoided.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein:

FIGS. 3A and 3B-1 and 3B-2 are front views of a window drain of the present invention installed under a sash window frame and an enlarged view thereof, respectively.

DETAILED DESCRIPTION OF THE INVENTION

The present invention is explained hereinbelow with reference to the Figures. However, the Figures are provided to illustrate the present invention. They should not be construed as limiting the scope of the present invention.

(Window Drain)

Figure 1A:
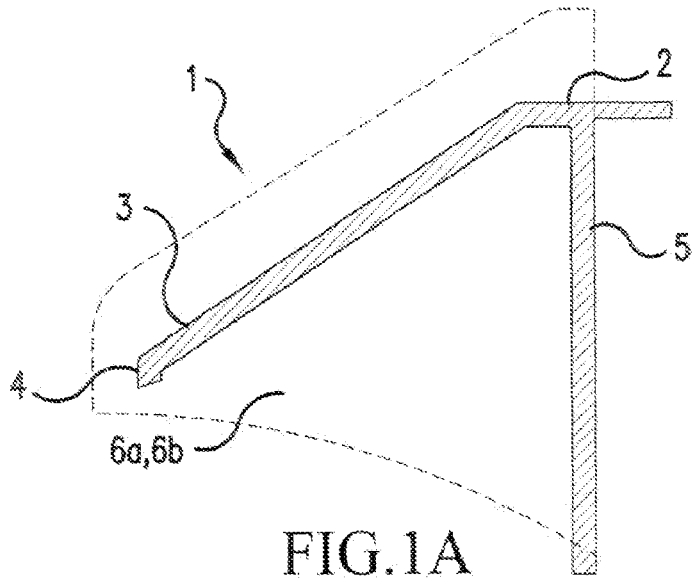
FIG. 1A is a sectional view and FIGS. 1B-1, 1B-2, 1C-1, 1C-2, 1D-1 and ID-2 are a perspective view, a front view and a top view of a window drain of the present invention, respectively.
Figures 1, 1B:
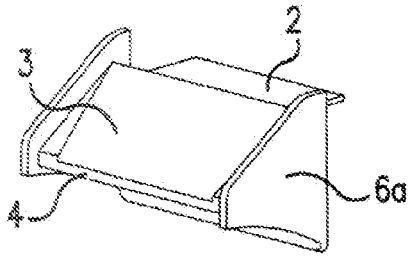
Figures 1, 1B, 2:
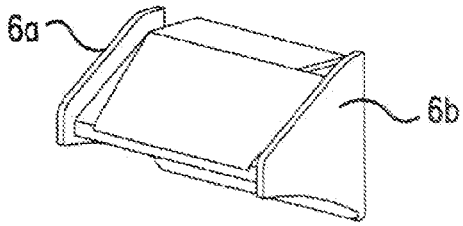
Figures 1, 1C:
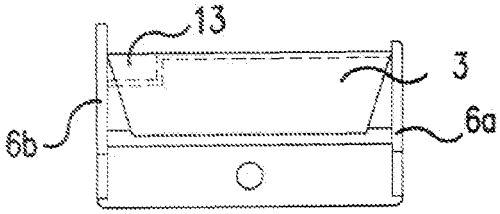
Figures 1, 1C, 2:
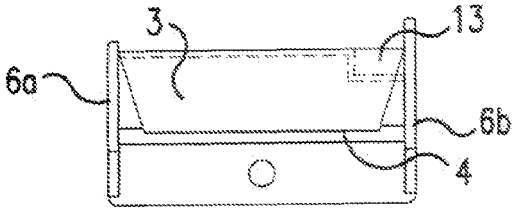
Figures 1, 1D:
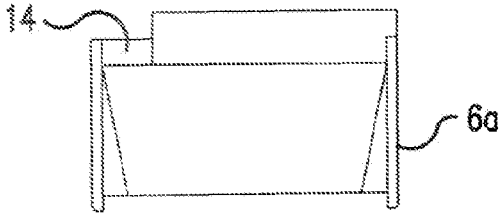
Figures 1, 1D, 2:
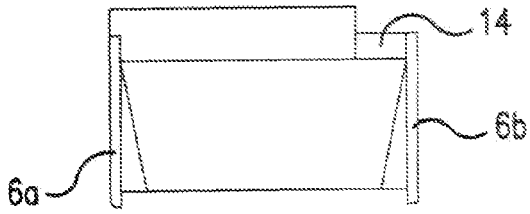
Figure 2:
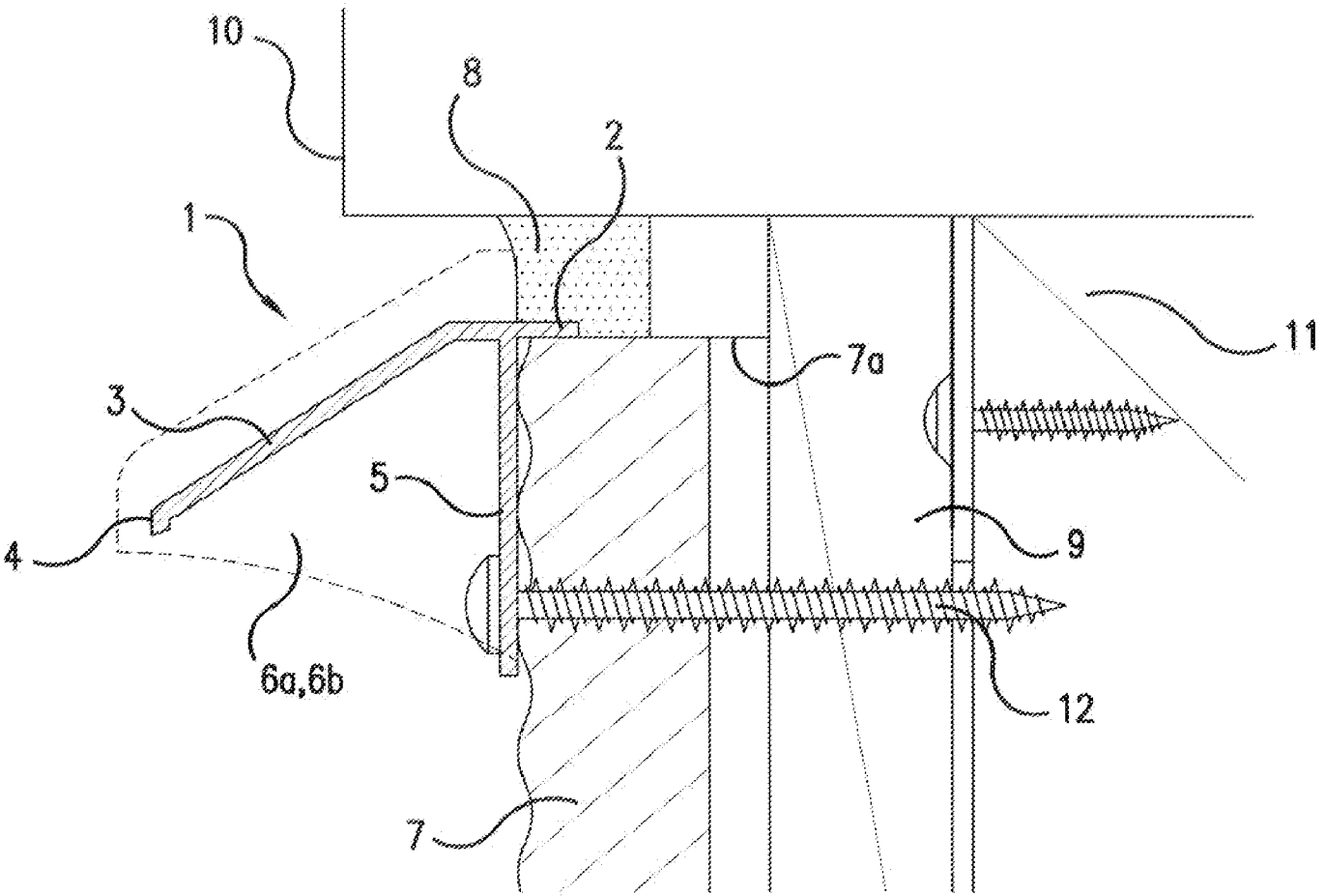
FIG. 2 is a sectional view of a window drain of the present invention, installed under a sash window frame.

As shown in FIGS. 1 to 1D-2, a window drain (1) has a vertical portion (5), a sloping portion (3), a front portion (4) and a horizontal portion (2) for latching the window drain to an upper portion (7*a*) of an external wall (7). The window drain can be installed between a lower portion of a sash window frame and an upper portion (7*a*) of an external wall (7). The horizontal portion has a notch at an end of the horizontal portion and a sealing pocket. Further, as shown in FIGS. 3A, 3B-1 and 3B-2, a window drain has, at both ends thereof, upstanding portions to regulate a stream of water (6) such as an upstanding portion disposed at the inner side (6*a*) and an upstanding portion disposed at the outer side (6*b*). The upstanding portion disposed at the inner side (6*a*) is located on the inner side of the vertical portion of a sash window frame (10), i.e., within the width of sash window frame (10). It is preferred that the height of an upper portion of the upstanding portion (6*a*) is approximately the same as the height of the lower portion of the sealing material (8). In other words, it is preferred that the height of the upstanding portion (6*a*) is sufficient to approximately reach the upper portion of the sealing material (8). The other upstanding portion (6*b*) is located at the outer side of the width of a sash window frame (the outer side of the vertical portion of sash window frame (10)). It is preferred that the height of an upper portion of the upstanding portion (6*b*) is approximately the same as the height of the upper portion of the sealing material (8). In other words, it is preferred that the height of the upstanding portion (6*b*) is sufficient to approximately reach the upper portion of the sealing martial (8). Material of such an upstanding portion is not limited. For example, such an upstanding portion can be made of metallic material or a resin.

(External Wall Material)

As the material for an external wall, for example, a cement board containing wooden reinforcement material such as wood chips, wood pulp, wood fiber and pulp (e.g., a wood chip cement board), a cement board formed by extrusion molding, a pulp cement board, a gypsum board, a calcium silicate board, a magnesium carbonate board, and a cement board can be employed.

(Sealing Material)

It is preferred that a sealing material seals the proximity of an upper portion of an external wall and has enough flexibility to follow shrinkage or swelling of an outer wall, which may occur after installation, so as to maintain the sealing property without cracks or separation. There is no particular limitation with respect to the sealing material. However, for example, a modified silicone polymer base sealing material, polysulfide polymer base sealing material, polyurethane polymer base sealing material, acrylic polymer base sealing material, or a butyl rubber base sealing material can be employed. Among them, a sealing material having sufficient elasticity such as a modified silicone polymer base sealing material, polysulfide polymer base sealing material and polyurethane polymer base sealing material can be preferably employed.

(Sealing Pocket)

A sealing pocket is positioned underneath the notch near an upstanding portion disposed at the outer side (6*b*) and comprises a space to hold a sealing material (8) therein. It is preferred that a window drain is installed so that the sealing pocket corresponds to the corner of the space along a sash window frame, to which a sealing material is installed. With this structure, the sealing pocket can be filled with a sealing material (8) and thus the area, at which the sealing material (8) contacts the external wall (7) behind the window drain (1), is increased, and eventually rain water, which comes down on a sash window frame and drops down to a window drain, is prevented from going behind the window drain. In other words, it is assured that rain water goes along the outer side of a window drain without going around the inner side of the window drain.

EXAMPLE

The present invention will hereinafter be described based on a specific Example. However, the Example is provided to illustrate the present invention but it should not be construed as limiting the scope of the present invention.

Example 1

An example of a procedure to install a window drain of the present invention is explained below.

As shown in FIG. 1A to FIG. 1D-2, a window drain (1) having a horizontal portion for latching to an upper portion of an external wall (2), a sloping portion (3), a front portion (4), a vertical portion (5), upstanding portions to regulate a stream of water (6*a*, 6*b*), a notch (13) and a sealing pocket (14) is provided. As shown in FIG. 2, a sash window frame (10) is fixed to a building wall or post (11), which is positioned underneath a sash window frame, with screws. Further, a furring strip (9) is installed as a support material for an external wall (7) under the sash window frame (10). Further, the horizontal portion (2) of window drain (1) is inserted to each of the spaces beneath the lower right and the lower left corners of the sash window frame and is temporarily held on the upper portion (7*a*) of the external wall (7). Then, while keeping the vertical portion (5) touching the external wall (7), the position to be installed is adjusted and then it is fixed to an external wall (7) with screws (12).

Figure 3A:
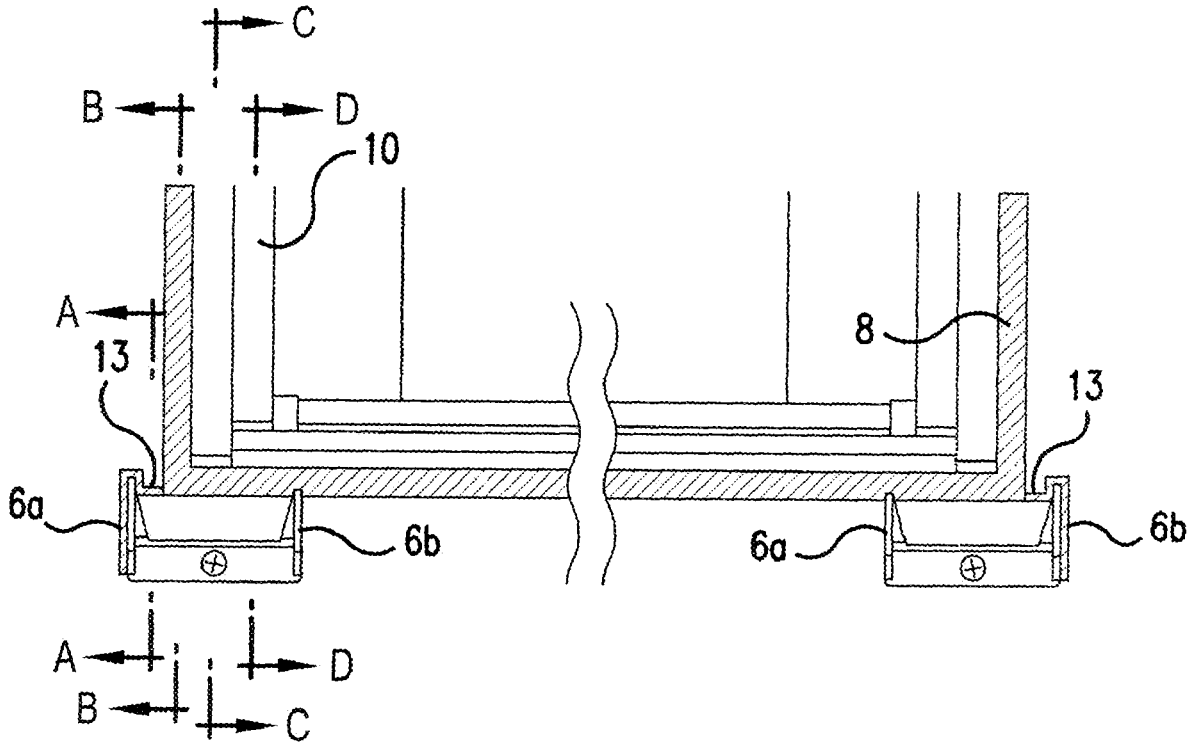
Figure 3A:
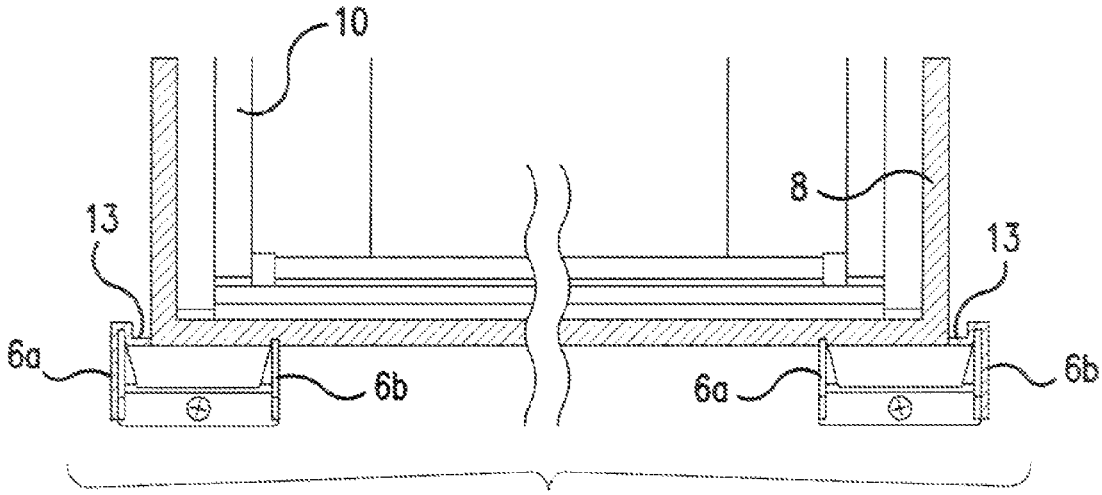
Figures 1, 3B:
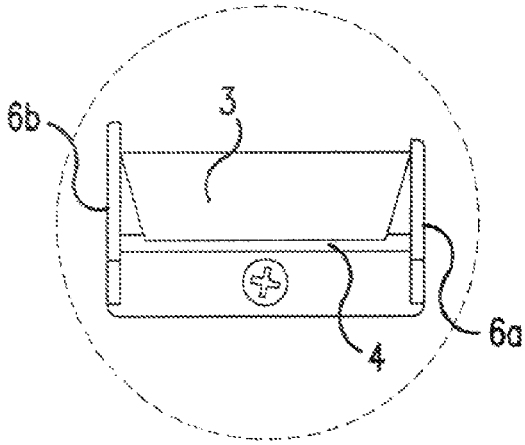
Figures 2, 3B:
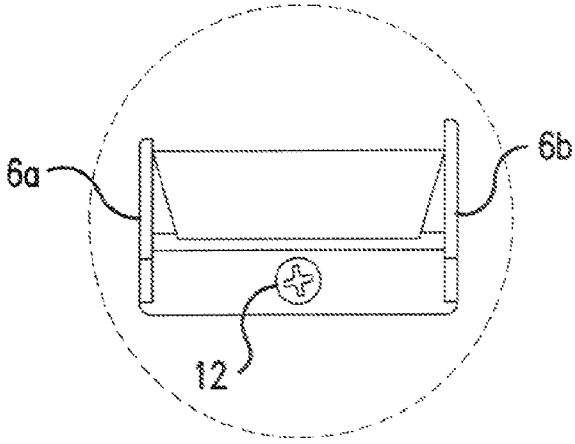

As shown in FIGS. 3B-1 and 3B-2, a window drain (1) is inserted in each of the spaces adjusted to a sealing material (8) at the lower right and the lower left corners of a sash window frame. This makes it easy to insert a window drain (1) in an external wall (7). Further, since the surface of an external wall which is adjacent to the space to which a sealing material (8) is installed is also sealed, a window drain can surely receive rain water which comes down along the sash window frame (10) and, further, the adhesiveness between an external wall (7) and the sealing material (8) can be kept in good condition. Then, the vertical portion (5) is fixed to the external wall (7)

with a screw (12). After fixing, the sealing (8) is installed and fixed at the space between the sash window frame (10) and the upper portion of the external wall (7*a*). It is preferred that a window drain to be installed at a right side is disposed so that the window drain has a notch and a sealing pocket at a right side, and that a window drain to be installed at a left side is disposed so that the window drain has a notch and a sealing pocket at a left side.

According to such a procedure, since the sealing material (8) is located underneath the sash window frame (10), the sealing material (8) can be hidden without being very visible. Further, since the sealing can be completed by sealing only the space between the right side of the lower sill of the sash window frame (10) and the external wall (7) and the space between the left side of the lower sill of the sash window frame (10) and the external wall (7), such an installation can be carried out easily and sealing is secured effectively.

Unlike conventional window drains and structures for preventing rain water from slipping down on the wall, according to the present invention, since each of the window drains can be held at the space, to which a sealing material is to be inserted, on an external wall by latching a horizontal portion thereof to an upper portion of the external wall and underneath each of the right vertical posts and the left vertical posts of the sash window frame, it can be installed easily. Further, since the window drain is disposed so that the horizontal portion partially covers the upper portion of the external wall together with the sealing material, it is not necessary for an extra sealing material to be installed on the window drain. Consequently, the window drain of the present invention can be installed easily and further, the excellent appearance of the window drain and the proximity thereof (e.g., a simpler appearance) can be obtained.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A window drain adapted to be positioned at the portion beneath each vertical post of a sash window frame comprising:

a horizontal portion for latching itself to an upper portion of an external wall;

a sloping portion extending downwardly from the horizontal portion;

a vertical portion extending downwardly from the upper end of the sloping portion;

a front portion extending downwardly from the lower end of the sloping portion, and first and second upstanding portions to regulate a stream of water so that the water is kept between the upstanding portions, at both ends of the window drain, wherein the horizontal portion has a notch at an end thereof bordered by the first upstanding portion and a sealing pocket positioned underneath the notch near the first upstanding portion.

2. The window drain of claim 1, wherein the second upstanding portion is adapted to be located at an inner side of a vertical portion of a sash window frame, and the first upstanding portion is adapted to be located at an outer side of the vertical portion of the sash window frame.

3. The window drain of claim 2, wherein the second upstanding portion is shorter than the first upstanding portion.

4. The window drain of claim 1, wherein the second upstanding portion is shorter than the first upstanding portion which is disposed near the sealing pocket.

* * * * *